US006702644B1

(12) United States Patent
Hornsby et al.

(10) Patent No.: US 6,702,644 B1
(45) Date of Patent: Mar. 9, 2004

(54) AMUSEMENT DEVICE

(75) Inventors: James R. Hornsby, St. Louis, MO (US); Joseph L. McGowan, St. Charles, MO (US); Chad P. Stuemke, St. Louis, MO (US); Marcellus R. Benson, Chesterfield, MO (US); Ryan A. Wolfinbarger, St. Louis, MO (US); Jason E. Emde, Fenton, MO (US)

(73) Assignee: All Season Toys, Inc., Malibu, CA (US)

( * ) Notice: Subject to any disclaimer, the term of this patent is extended or adjusted under 35 U.S.C. 154(b) by 0 days.

(21) Appl. No.: 09/711,484

(22) Filed: Nov. 13, 2000

Related U.S. Application Data

(60) Provisional application No. 60/165,572, filed on Nov. 15, 1999.

(51) Int. Cl.[7] ..... A63H 11/00

(52) U.S. Cl. ..... 446/330; 446/175; 446/310; 446/268

(58) Field of Search ..... 446/330, 310, 446/268, 72–73, 75, 297, 175, 369, 304, 335

(56) References Cited

U.S. PATENT DOCUMENTS

| | | | | | |
|---|---|---|---|---|---|
| 868,632 | A | | 10/1907 | Almstrom et al. | |
| 1,585,887 | A | | 5/1926 | Beach | |
| 2,611,997 | A | | 9/1952 | Solloway et al. | |
| 2,651,881 | A | | 9/1953 | Glass et al. | |
| 4,197,670 | A | | 4/1980 | Cox | |
| 4,237,649 | A | | 12/1980 | Goldfarb et al. | |
| 4,736,943 | A | | 4/1988 | Fukuda et al. | |
| 4,775,352 | A | | 10/1988 | Curran et al. | |
| 4,817,936 | A | | 4/1989 | Matsuda | |
| 4,836,821 | A | | 6/1989 | Raymond | |
| 4,840,602 | A | * | 6/1989 | Rose | 273/460 |
| 4,857,030 | A | * | 8/1989 | Rose | 340/539 |
| 4,883,442 | A | * | 11/1989 | Kaplan | 446/320 |
| 4,923,428 | A | | 5/1990 | Curran | |
| 5,363,994 | A | * | 11/1994 | Angeline | 106/287.11 |
| 6,149,490 | A | * | 11/2000 | Hampton et al. | 446/298 |
| 6,309,275 | B1 | * | 10/2001 | Fong et al. | 446/175 |

* cited by examiner

*Primary Examiner*—S. Thomas Hughes
*Assistant Examiner*—Alex F. R. P. Rada, II
(74) *Attorney, Agent, or Firm*—Dorsey & Whitney LLP

(57) ABSTRACT

The present invention provides an interactive amusement device which gives birth to one or more offspring, wherein the device includes appropriate electromechanical interactive sensors and operating mechanisms. It encompasses a "mother" amusement device which is interactive with a user, and which appears to give birth spontaneously to one or more "baby" amusement devices. In some embodiments, the mother and baby(ies) may be interactive with the user and each other.

21 Claims, 18 Drawing Sheets

AMUSEMENT DEVICE

The present application claims the priority of a U.S. provisional application, Ser. No. 60/165,572, filed Nov. 15, 1999.

BACKGROUND

The present invention relates to toys and amusement devices and, in one embodiment, an electromechanical interactive amusement device which gives birth to one or more offspring. The present invention encompasses a "mother" amusement device which is interactive with a user, and which appears to give birth spontaneously to one or more "baby" amusement devices. In some embodiments, the mother and baby(ies) may be interactive with the user and each other.

SUMMARY OF THE INVENTION

In one embodiment, the present invention provides an interactive amusement device comprising a parent, a mother, and at least one offspring, a baby.

In one embodiment, the mother comprises a body with a skin and an internal structure that provide an internal space with an exit opening. The skin may include a pouch generally overlying the opening. The internal space carries a moveable container structure, a portion of which may removably close or occlude the opening. In one embodiment, the container structure is releaseably lockable in an open position and, when closed after opening once, is permanently locked in the closed position. In another embodiment, the container structure is releaseably lockable in an open position and, when closed after once being open, is releaseably locked in the closed position, whereby it may open or be opened again. The mother further comprises an internal operating mechanism operably coupled to the container structure and to one or more of a plurality of sensors and/or inputs carried by the body and/or internal structure. In some embodiments, the internal operating mechanism may be automatic, that is, operable in response to a condition or trigger independent of intentional user input. In some embodiments, at least a potion of the internal operating mechanism may be automatic, and the mechanism may also be coupled to inputs for deliberate, intention manipulation by a user to actuate the operating mechanism or a portion thereof. The operating mechanism powers, drives or operates the container structure, and other operational features, attributes or functions of the mother. In some embodiments, a single operating mechanism, e.g, an electric motor, or multiple discreet or multiple interlinked operating mechanisms, may be used to power, drive or operate operational features, attributes or functions of the mother. The operational features, attributes or functions of the amusement device, either one or both the parent figure and child figure, may include, in addition to the moveable container structure, other movable portions, including, for example, a moveable head-like portion, and/or movable eyes, mouth, appendages, etc. The sensors and/or inputs may be intentional or inadvertent user touch or contact-type switches, gravity switches, reed switches and/or magnetic or magnetically sensitive switches, or movement, light (e.g., visible, IR, etc.) or sound sensitive sensors or switches. In addition, the mother and baby, and/or portions thereof, may be adapted to emit sounds, light or heat; suitable speakers and/or sound chips or boards, light bulbs or LEDs, and heat producing or radiating elements, e.g., resistors or heating elements, may be provided. In some embodiments, portions of the mother may be positionable by being flexible, wherein they are able to be manipulated into a selected position, or may moveable resiliently or under the influence of gravity, e.g., if the mother has appendages, such may be positionable by a user.

In one embodiment, the amusement device of the present invention is an interactive electronic device, largely an amusement device and largely digital, and it may display animation or movement with sound effects. The movement and/or sound effects may be interactive with a user, for example, in response to deliberate or unintentional user input, such as sound, contact, movement or selective actuation (e.g., though a button, touch panel or the like). The interactivity could also be in conjuction with like devices, including other "mother" devices and/or "baby" devices, or it may be generated by or be responsive to ambient conditions such as sounds (e.g., music or voice), nearby movement, temperature, light level or other conditions or situations.

In one embodiment, the amusement device comprises an interactive system, in turn comprising an electronic system for use with a suitable electric motor and linkage(s) to drive, receive, actuate and control movement, and an audio component for receiving and broadcasting sound, wherein a user of the system may interact with the system, and a software controller for carrying out functions in accordance with a software program stored in a software controller and in accordance with certain selected input data supplied by the user and certain additional input data stored in another system memory, wherein said certain additional input data is received and processed by the software controller.

The interactive device of the present invention provides and encompasses a method for controlling operation of the device comprising providing a visual output, providing an audio output on an audio output device, receiving input from an input device, and controlling visual output and the audio output device based on received input. The input device may receive input by being manipulated physically and/or intentionally, or it may receive input comprising an ambient condition and, in response to the input, the method comprises at least a first mode providing the visual output and a second mode providing the audio output, which modes may be provided at different times or concurrently. Additional modes may be provided.

An advantage of the amusement device of the present invention is that it increases the appeal and interactivity of such devices by, for example, appearing to spontaneously produce sounds or movement with or without intentional input from the user, observer or adjacent device, which sounds or movements may provoke or require a response from a person observing the device.

In one embodiment, the baby is initially nested, and/or hidden, inside the mother, in the container structure. It may be contained in a container, e.g., an "egg," removably carried in the container structure. The baby and the mother may have generally similar attributes. However, in some embodiments, the baby is smaller and may not include the moveable "birthing" container structure carried by the mother. The baby may have a skin and an internal structure similar to that of the mother, and it may be provided with movable portions, including, for example, a moveable head-like portion, and/or movable eyes, mouth, appendages, etc. The baby may have sensors and/or inputs including, for example, intentional or inadvertent user touch or contact-type switches, gravity switches, reed switches and/or magnetic or magnetically sensitive switches, or movement, light (e.g., visible, IR, etc.) or sound sensitive sensors or switches. In addition, the baby, and/or portions thereof, may be adapted to emit sounds, light or heat; suitable speakers and/or sound boards, light bulbs or LEDs and heat producing elements may be provided.

In one embodiment, the mother requires input, i.e., a user must interact or play with her for a selected period of time before the mother will give birth to the baby. In this or other embodiments, the mother may go to "sleep," i.e., become inactive, in the absence of stimulus, particularly in the absence of stimulus or input from the user. In one embodiment, "birth" or "delivery" comprises an apparently spontaneous movement of the container structure and opening of the opening, the user then removing the egg from the container structure, and opening it to reveal at least one baby. The birth of thebaby, i.e., the movement of the container structure, may be a timed event, i.e., it may occur after a certain elapsed time or after a measured period of use, or it may happen in response to a particular, and variable, input, for example, the user touching a selected location of the mother or touching the mother a selected number of times. The container structure may be provided with devices to help the user remove the egg, e.g., a coil or leaf spring, or a pull tab or a ribbon.

In one embodiment, the amusement device of the present invention comprises a first figure representing a mother and comprising a body having an interior space and an opening into the space, a container structure movably received in the space, and an operating mechanism operably coupled to the container structure to move at least a portion of the container structure to block and unblock the opening, and a second figure representing a baby of the mother, and receivable in and removable from the container structure through the opening when the opening is unblocked. In one embodiment, the opening may be blocked and unblocked repeatedly, and in another embodiment, it is initially blocked and may be unblocked and reblocked once.

In one embodiment, an advantage of the present invention is that it may be "reloaded" for birthing of more than one baby, thereby providing for continued amusement of the user. In another embodiment, the birth may be a one time occurrence.

In some embodiments, operational or functional aspects of the amusement device of the present invention may be controlled by a microprocessor or computer, including one or more suitable printed circuit boards.

Other features and advantages of the amusement device and method of the present invention will become more fully apparent and understood with reference to the following description and drawings.

BRIEF DESCRIPTION OF THE DRAWINGS

FIG. 11, including

FIG. 12, including

FIG. 13,including

FIG. 14, including

FIG. 15, including

FIG. 17, including

FIG. 18, including

DESCRIPTION

Figure 1:
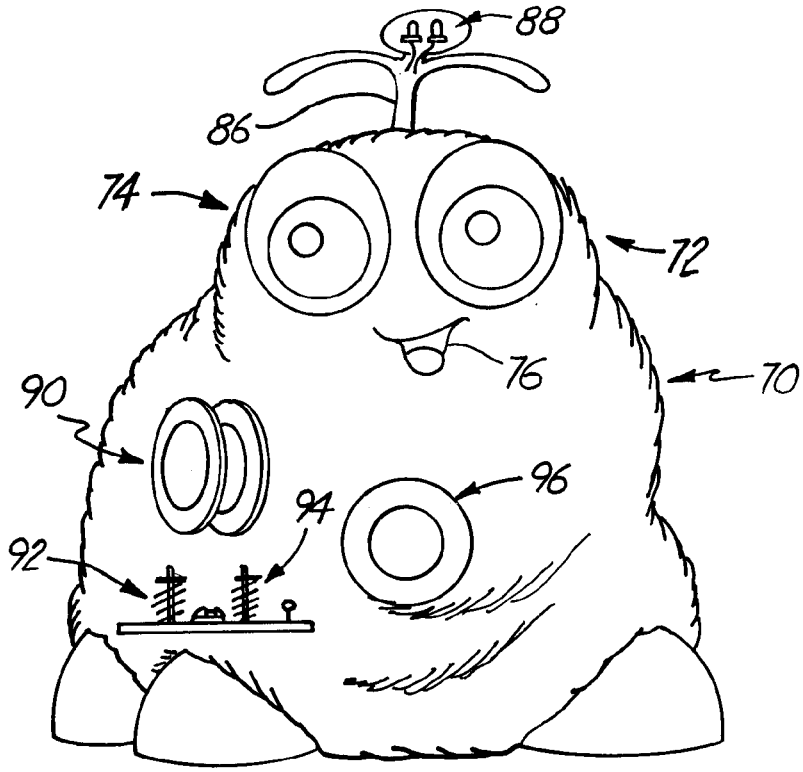
FIG. 1 depicts one embodiment of one feature of one embodiment of the amusement device of the present invention, namely, a mother amusement device.

Features and advantages of the amusement device apparatus and method of the present invention will become more fully apparent and understood with reference to the above-referenced drawings, this description and the appended claims, including embodiments of an interactive birthing amusement device (which also may be referred to as a toy), and features and components thereof, and the description of the method or process by which the toy interacts with a user, another toy or an ambient condition, and gives birth.

With regard to fastening, mounting, attaching or connecting the components of the present invention to form the device or apparatus as a whole, unless specifically described otherwise, the invention may incorporate or use conventional fasteners such as screws, nut and bolt connectors, machined connectors, snap rings, clamps such as screw clamps and the like, rivets, nuts and bolts, toggles, pins and the like. Components may also be connected by adhesives, sewing, welding, friction fitting or deformation, if appropriate. Electrical features and functions may be accomplished by using suitable electrical devices, including motors, speakers, sensors, inputs, outputs, printed circuits, pc boards, chips and the like, and electrical connections may be made using appropriate electrical components and connection methods, including available components, connectors and connecting methods. Mechanical and mechanical operational features may be accomplished by using suitable mechanical devices, including motors, cams, links and linkages, drive trains, gears, shafts, pins and the like. Unless specifically otherwise disclosed or taught, materials for making components of the present invention are selected from appropriate materials such as metal, metallic alloys, fibers, fabrics, plastics and the like, natural or synthetic, and appropriate manufacturing or production methods including casting, extruding, weaving, spinning, molding and machining may be used.

Any references to front and back, right and left, top and bottom and upper and lower are intended for convenience of description, not to limit the present invention or its components to any one positional or spacial orientation.

As used herein, the terms "parent" and "mother" are intended to mean a parent creature, figure or character, an older creature, figure or character, or older clone or twin creature, figure or character, and the terms "child" and "baby" are intended to mean an offspring creature, figure or character, a younger and/or smaller creature, figure or character, or a younger and/or smaller clone or twin creature, figure or character. The subject creature, figure or character of the present invention, including the mother and baby, may be generally representative of reality, i.e., human, animal and the like, or may be entirely imaginary or whimsical.

The embodiments of the amusement device of the present invention include a suitable data and control operating or processing system or systems, typically in the form of a computer or one or more microprocessor boards or chips (for example, integrated circuits or printed circuit boards) contained within the amusement device. See, for example, FIG. 3, reference 30. These printed circuit boards or chips may be configured as desired and convenient for particular embodiments and functions, and may be constructed and located as suitable for particular embodiments. A plurality of selected inputs (e.g., buttons, gravity sensor/switches, touch sensitive switches, magnetic switches, temperature sensors and/or microphones) may be operably connected to the microprocessor or directly to operational or functional features (e.g., in analog embodiments), as may be a plurality of selected outputs, e.g., motor, light sources and speaker. A reset input (not shown) may also be coupled to the microprocessor 30. The microprocessor 30 may comprise one chip, or more, and future performance needs and features (e.g., audio enhancements, RAM, etc.) may involve the use of multi-chip sets. A chip or chips may be function specific or two or more functions or operations may be controlled by a single chip.

Figure 24:
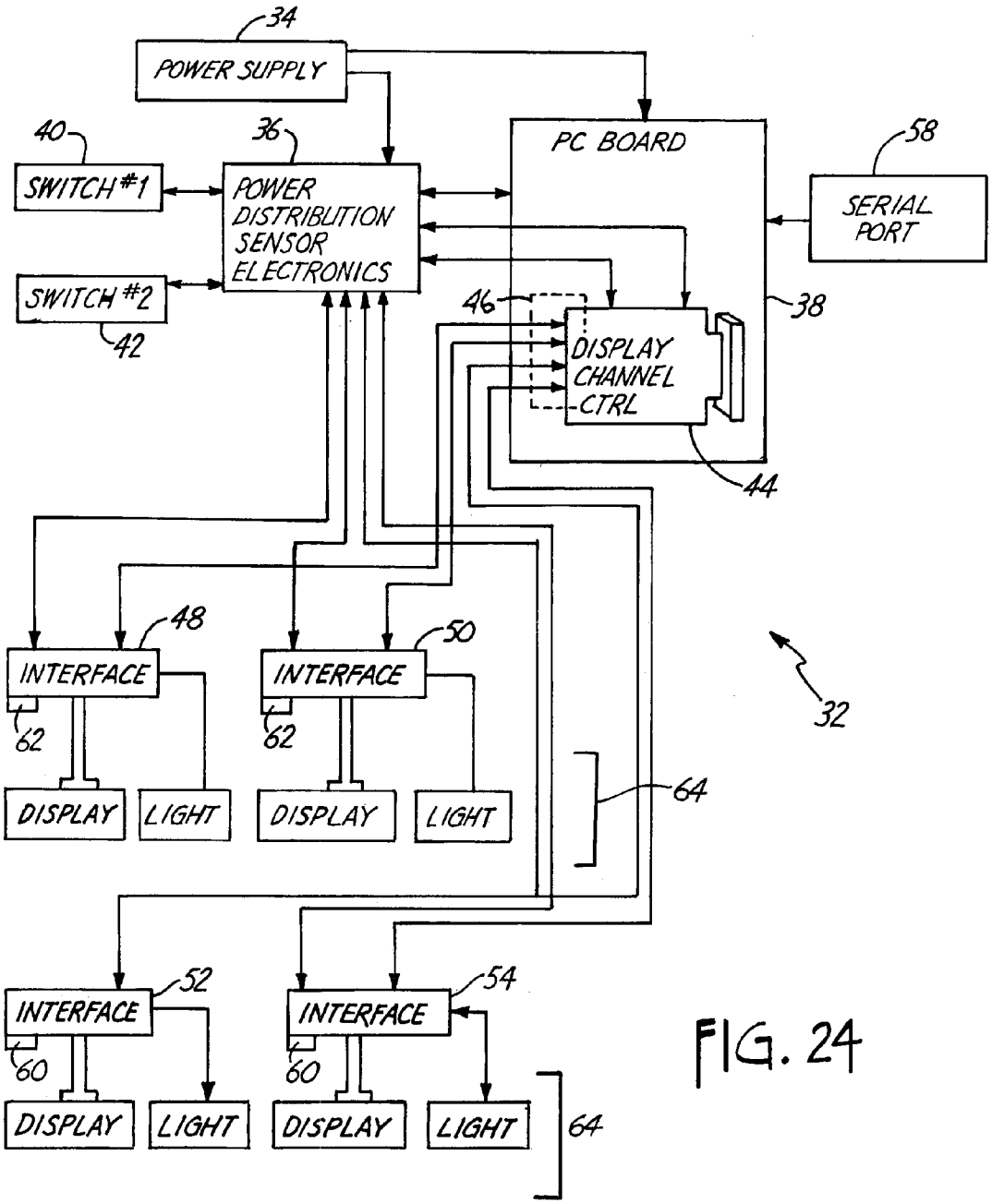
FIG. 24 depicts one embodiment of an electronic operating system suitable for use in the present invention, including one embodiment of a microprocessor controller.

FIG. 24 depicts a representative selection and arrangement of the electronics or electronic circuitry and related components which may be used in embodiments of the invention. The depicted control and data processing system 32 includes a suitable power supply 34, typically a battery or a direct current supply of a suitable voltage (e.g., a battery or battery assemblies), but other power supplies, such as solar cells, may be used or incorporated as well. Power is supplied to a power distribution and sensor electronics control circuit 36. Control circuit 36 can be one or a combination of several commercially available power switching and control circuits, and may be provided in the form of a circuit or circuit board which is detachable, and plugs into a main board or chip 38 or a suitable expansion slot board receptacle.

Power control circuit 36 may be connected to a first exemplary input control switch 40 and a second exemplary input control switch 42, or to as many such switches as are desired or necessary. The switches may be operated by inputs, such as sensors or switches, of the present invention. In one embodiment, for example, one switch may control powering up the system, and the second switch may control activation of aspects of the programs or modes of operation. There may be one or more additional switches, buttons or inputs, or functions may be combined in a button by the selective operation thereof, and the system 32 can include default settings or subroutines.

FIG. 24 also depicts a controller board, circuit or chip 38 which comprises a central microprocessor (not shown) and related components well-known in the industry as computers or printed circuit boards, for example, four or eight bit microprocessors such as those made and offered for sale by Elan Microelectronics Corporation and others, and related memory (not specifically shown). A variety of different configurations and types of memory devices can be connected to a suitable pc or board as is well-known in the art. A control board 44, and/or an optional second such board 46 (shown in phantom), may be included. The board 44 typically would be connected or operably coupled to the board 38, for example in expansion slots of circuit board 38, and would be capable of controlling operational parameters of the present invention. Additionally, the control board 44 may be connected to one or more interface circuits 48, 50, 52, 54.

The circuit board 38 may include a port 58 to allow data to be programmed or downloaded. This allows performance data to be analyzed in various ways using added detail, or by providing integration with data from other devices so that performance problems can be identified and eliminated. In some embodiments, performance requirements, user use, responses, performance and/or skill can be varied or manipulated, recorded and displayed, or downloaded. The board 38 also may have a number of optional sensor interface connections 60 or control input interfaces 62 for sensing of ambient conditions (light or sound sensors) or direct input through the use of inputs (such as buttons, touch sensitive switches or the like).

The processor or controller 32, whatever form it takes, includes software or programming which is used in the operation of the present invention, including the interactive aspects. It should be understood that the particular software used may vary dependent upon, for example, the desired input and output options and/or interactivity, e.g., the movement(s) displayed and the sound(s) produced. There may be modifications to the software and program routines to accomplish changes, or such may be required in connection with the wide variety of performance, functions, characters, activities, movement, displays, actions and sounds available.

The processor 32 includes suitable operational modules, e.g., modules 64, for performing a number of data processing function in connection with the selected and preferred operations. One function is receiving user input and translating it into a selected action. Other representative functions include, but are not limited to, producing and/or controlling an audio output, both or selectively in response to a sensed ambient condition or stimulus or in response to user input, producing and/or displaying audio and/ or visual inquiries or prompts of the user, sensing functions, and/or displaying actions or movements in response to user inputs.

Referring to FIG. 1, the present invention provides a mother figure, or "mommy," 70 interactive amusement device which, as depicted by the movement lines adjacent to the mother figure, includes movable portions. For example, the head portion 72 of the device 70 moves up and down, the eyes 74 may move all around in a random fashion and the mouth 76 moves in an eating and/or speaking or noise making manner. The mother device 70 includes suitable internal electromechanical drive mechanisms to accomplish these motions, including (as set forth below) at least one motor 80 which may be actuated to deliver an egg 82 and/or baby 84, to wobble the head 72, and move the eyes 74 and the mouth 76.

With continued reference to FIG. 1, the mother amusement device 70 includes a plurality of communication and sensor devices. These devices are intended to communicate or show or symbolize that the amusement device feels and communicates emotions. For example, the device 70 includes an antenna assembly 86 which carries colored LED's 88 or other appropriate light sources which may flash on and off, for example, in red if the amusement device 70 is "angry" or green if the amusement device 70 is "happy." Additionally, the device 70 may be provided with suitable clap sensors 90 whereby the device 70 appears to respond positively to soft or gentle sounds and negatively to loud or abrupt voices or sounds. The sensors 90 also allow the mother device 70 to listen for the baby device 84 when it "talks" or make sounds. In one embodiment, if the mother device 70 hears the baby 84, the mother device 70 will respond. The mother device 70 also may include shake or movement sensors wherein a light shake sensor 92 detects gentle movements and the device responds positively (e.g., the green LED comes on) and a heavy duty shake sensor 94 which detects rough movement to which the mother 70 will respond negatively. The device 70 is also provided with a suitable sound emitting device(s) 96, for example, a 0.29 millimeter speaker, so that the mother device 70 may emit sounds or talk.

Figure 2:
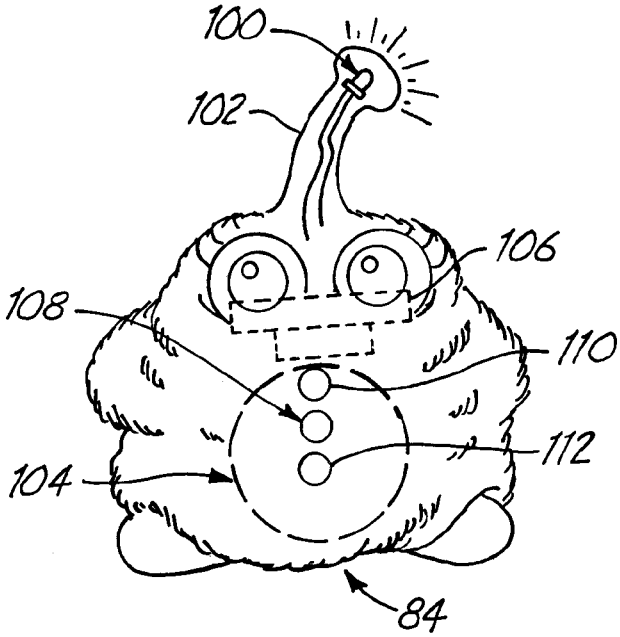
FIG. 2 depicts one embodiment of another feature of one embodiment of the amusement device of the present invention, namely, a baby amusement device.

FIG. 2 depicts a baby amusement device 84 which may be provided with generally similar sensing and communication devices as the mother device 70, including suitable light sources such as LED's 100 inside its antenna 102, two clap sensors 104 whereby the baby device 84 may sense and respond to soft voices or sounds positively and loud voices negatively, and which allow for the baby device 84 to listen for the mother device's or other sounds. The baby device 84 further comprises a speaker 106 so that the baby 84 can talk or emit sounds, a magnet 108 for providing for a kissing function as will be explained herein below, an inputs such as feeding push buttons 110 and/or wake-up push buttons 112 for actuating the baby device 84.

Figure 3:
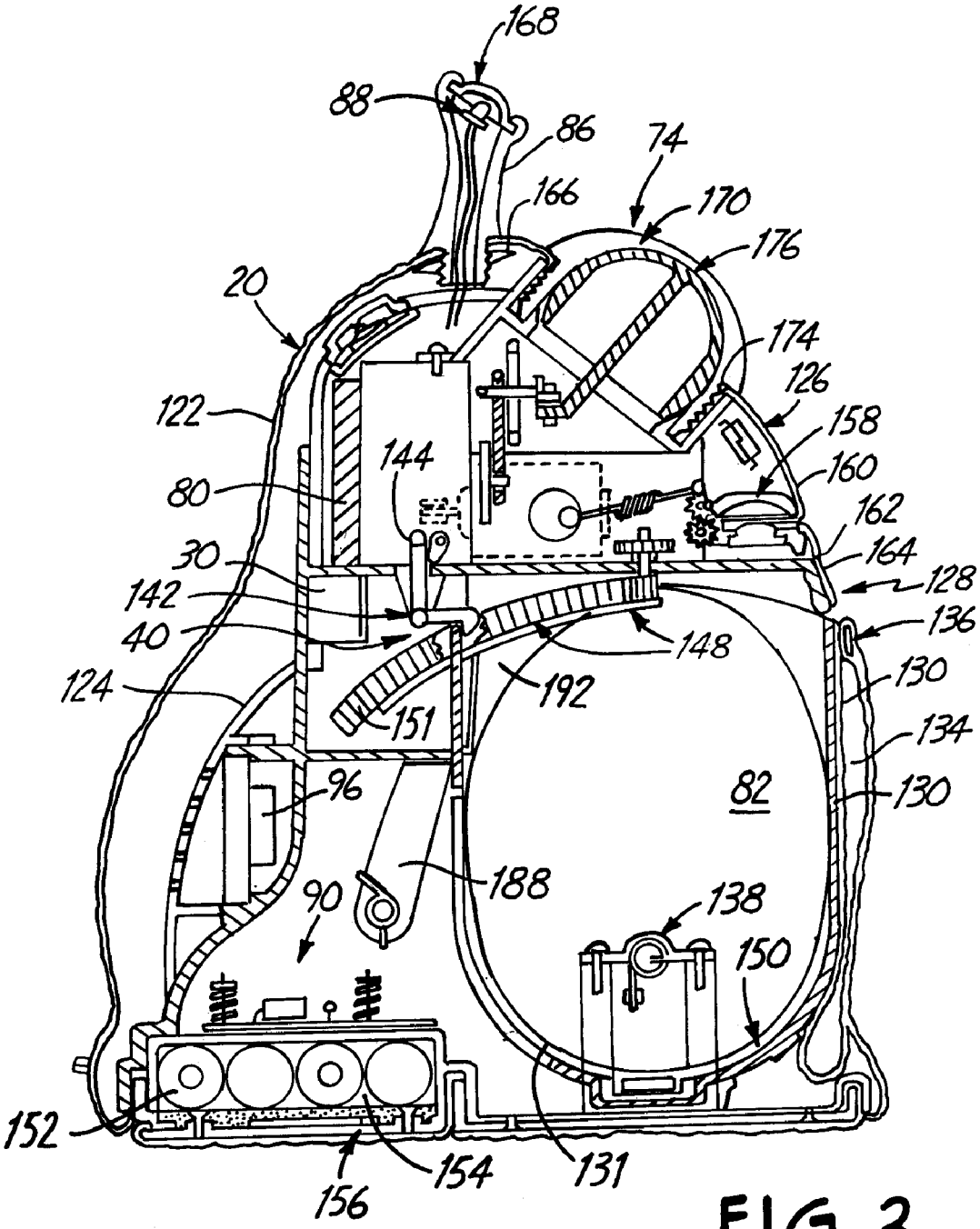
FIG. 3 is an elevational side view of one embodiment of the mother of the present invention, with portions in section and/or broken away to show internal and/or operational features.
Figure 4:
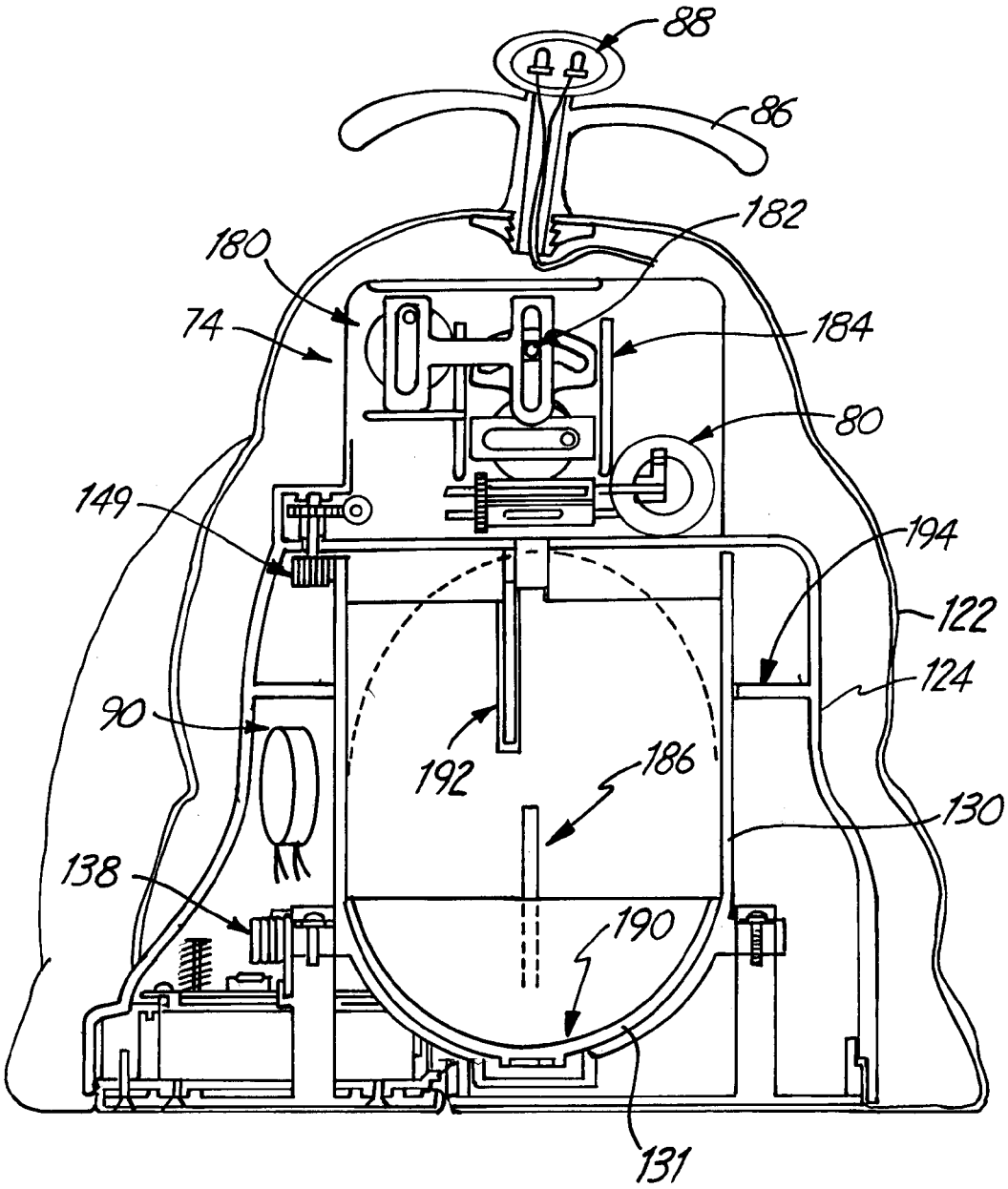
FIG. 4 is an elevational front view of one embodiment of the mother of the present invention, with portions in section and/or broken away to show internal and/or operational features.

FIGS. 3 and 4 are side and front elevational layout views, respectively; with portions of the device 70 of the present invention depicted in section and portions broken away for clarity. Referring to FIGS. 3 and 4, particularly FIG. 3, the mother device 70 of the present invention includes a body 120 having a skin 122 and an internal frame 124. The frame 124 supports an eye assembly 74, an antenna assembly 86, a head housing 126 and a body housing 128. Input and output mechanisms are suitably mounted on or adjacent to the frame 124 and generally under the skin 122. The head housing 126 contains or supports the mechanism which moves the head 72, eyes 74, mouth 76, and opens an internal container 130. The internal container contains an egg basket 131 is provided for containing the offspring or baby device 84 and is located generally at the front of the mother device 70 behind a pouch 134 formed in the skin 122. The pouch 134 has an elastic band 136 on its rim to return it to a closed position.

The container 130 is pivotally mounted to the frame 124 and includes a torsion spring 138 for returning it to its closed or internal position. The birthing mechanism 140 of the present invention includes a lock 142 which keeps the container 130 closed, and a cam 144 which opens the lock 142 for a birth to occur, as described herein below. A rack gear and pinion 148 linked to the motor 80 is provided to open the container 130 for birth, and the birthing mechanism 140 may be provided with a reed or other suitable switch 150 to let the microprocessor controller 30 know if an egg 82 or baby 84 is inside the container 130. Power is provided by four suitable batteries or other suitable power source 152. If batteries are used they may be received in a battery compartment 154 closed by a hatch 156 supported by the frame 124 at the base of the mother device 70.

With continued reference to FIG. 3, the internal frame 124 supports a mouth moving mechanism 158 wherein an arm 160 adjacent to the mouth may be moved by a cam or gear arrangement 162 to open and close the mouth 76 to provide an eating or simulated eating function. Further detail is described below with reference to FIG. 18.

The internal frame 124 includes a built-in stop 164 so that the internal container 130 cannot open too far.

The antenna 86 is formed of suitable materials such as a PVC material and may be attached to the skin 122 as, for example, by a retaining ring 166 positioned on the inside of the skin 122. The antenna 86 is provided with suitable colored LED's or other light sources 88 which may blink or be continuously on or off. The light sources 88 are mounted behind suitable lenses 168 such as ABS lenses, which may be glued into the antenna body 86 and which help defuse the light provided by the light sources.

The eye assembly 74 of the present invention may be supported on the internal frame 124, and includes a clear lens 170 exterior surface which is glued into an eye socket 174. An eye ball 176 is trapped between the lens 170 and the socket 174, and free floats in the manner of a ball joint.

Referring to FIG. 4, the eye assembly 74 includes a bidirectional cam mechanism 180, trapping a pin 182 which is attached to the eyes 74 and which, when moved, moves the eyes 74. The eye assembly 74 may include molded guide flanges or portions 184 attached to the frame 124, and FIG. 4 depicts one approximate location of the motor 80, which may be a suitable electric motor, for providing the movements of the mother device 70, including the eye movement, the head up and down movement and the wobble.

FIG. 4 also depicts additional features of the birthing mechanism 140 including a slot 186 on the container 130 for a catch arm 188 (see FIG. 3) which follows the container 130 and rotates into the container 130 to keep the egg 82 from being put back into the container 130 after a birth. Also seen is an egg ejector 190 which is provided to urge an egg 82 half-way out of the container 130 during the birth cycle. A rib 192, also visible in FIG. 3, may be provided to hold the egg 82 in position when the container 130 is closed. Container supports 194 are provided adjacent to the container 130. In operation, the pinion gear 149 is operated by the motor 80 to drive the container 130 open along the rack 151. FIG. 4 also depicts one possible location for the clap sensors 90. It also depicts how the skin 122 or fabric forming the skin may be trapped by adjacent portions of the frame 124 or other support mechanisms.

Figure 5:
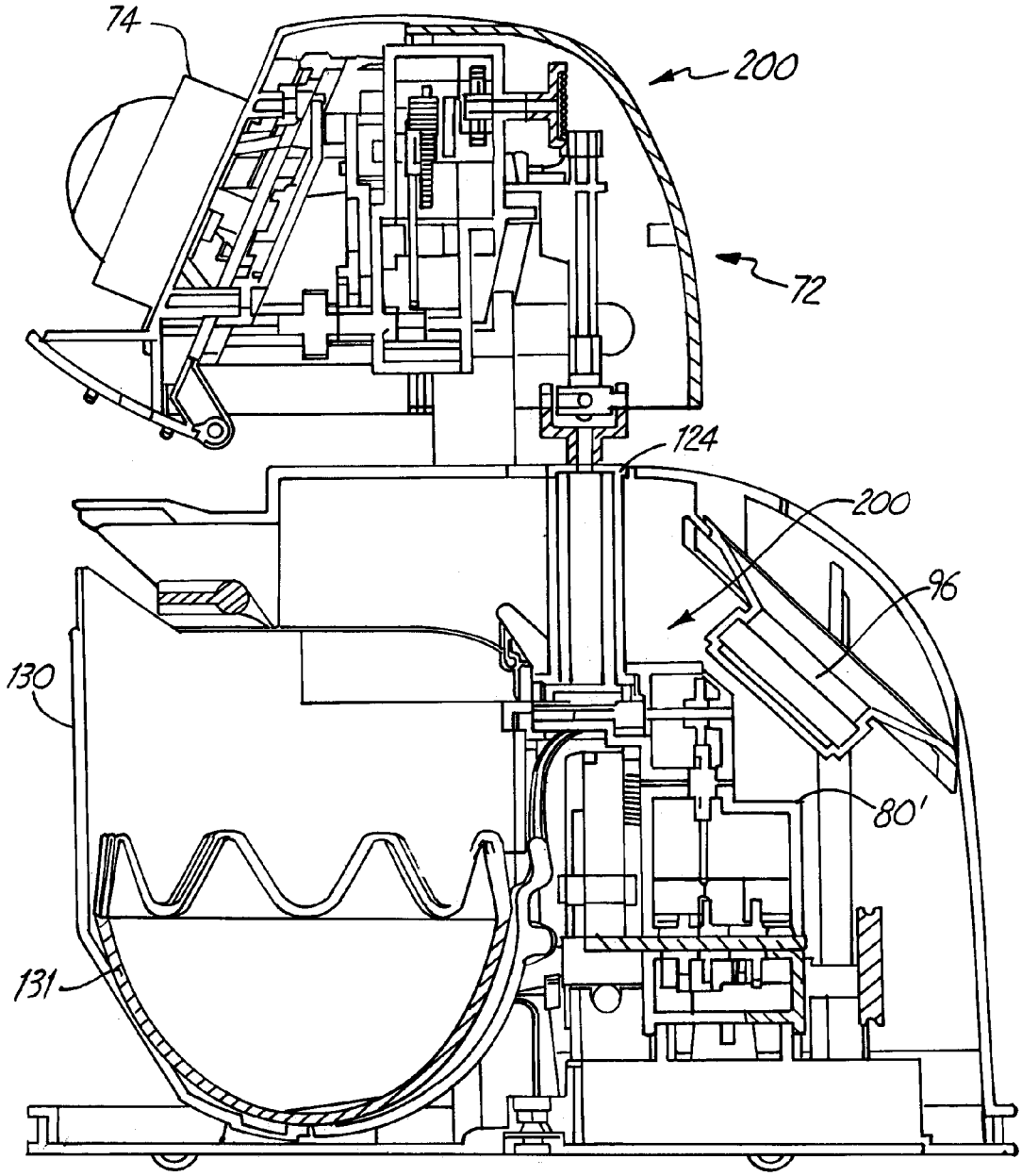
FIG. 5 is an elevational side view of an embodiment of the mother of the present invention, with portions in section and/or broken away to show internal and/or operational features.

FIG. 5 is a sectional view with portions broken away depicting another embodiment of the mother device of the present invention, including substantially the components referenced with respect to FIGS. 3 and 4. Note that a single motor 80' and suitable gear and arm transmission arrangements 200 may be used to drive the mechanisms for opening the egg container 130 and for providing for movement of the head 72 and other movements of the mother FIG. 70.

Figure 6:
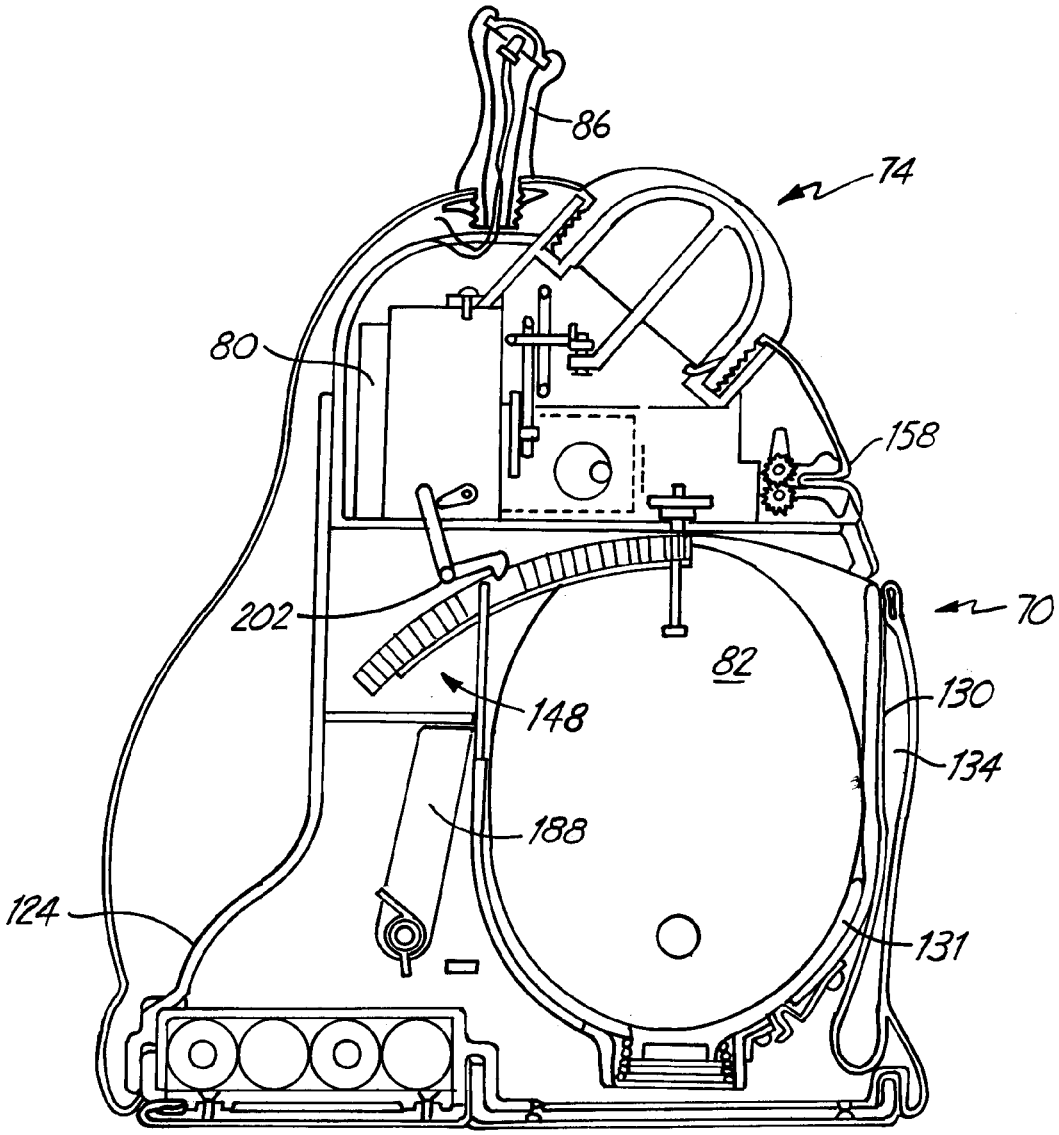
FIG. 6 is an elevational side view of one embodiment of the mother of the present invention, with portions in section and/or broken away to show internal and/or operational features and also to show an initial step in the method of the birthing or delivery process of the present invention.
Figure 7:
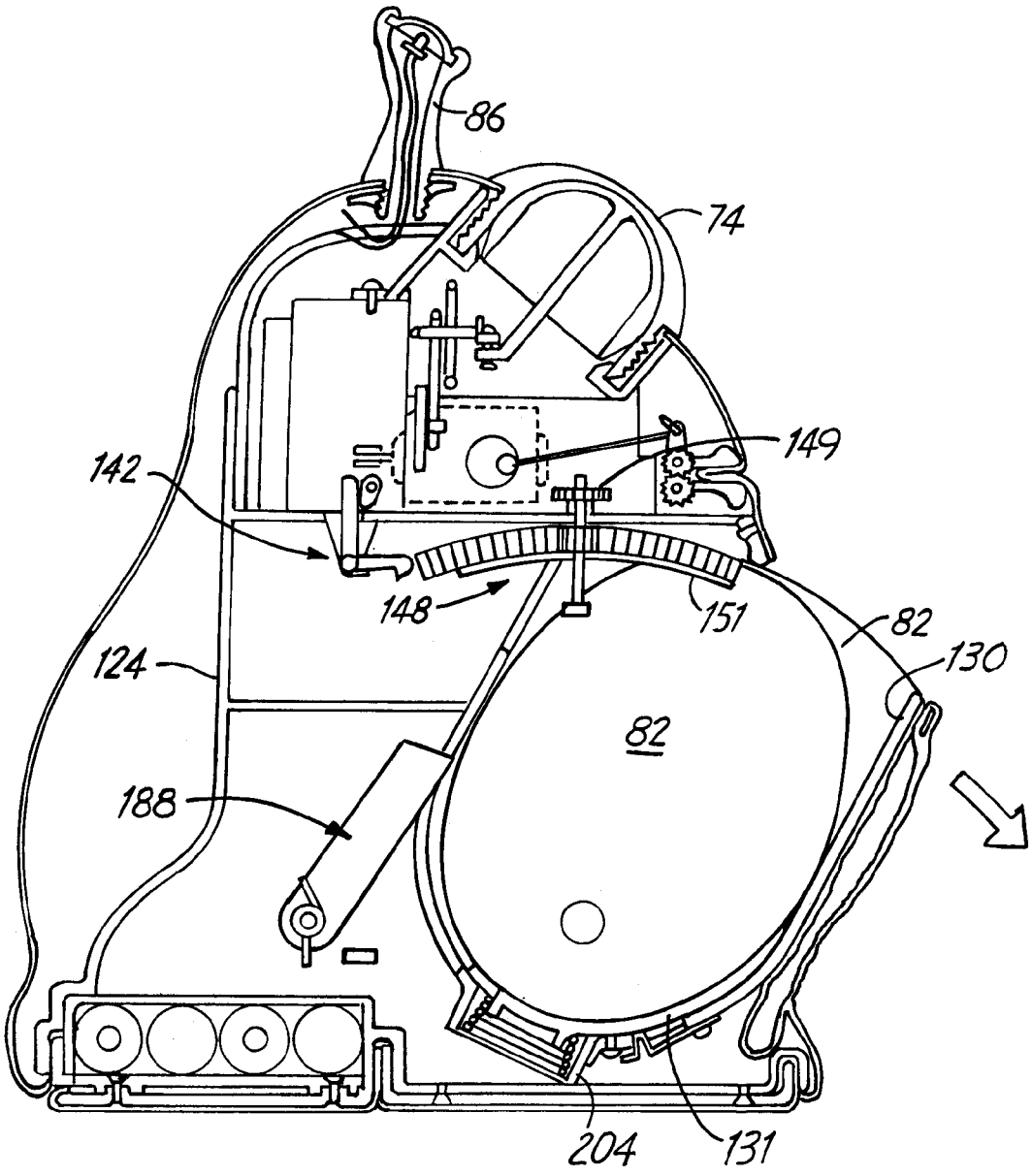
FIG. 7 is an elevational side view depicting another step in the method of the birthing or delivery process of the present invention.
Figure 8:
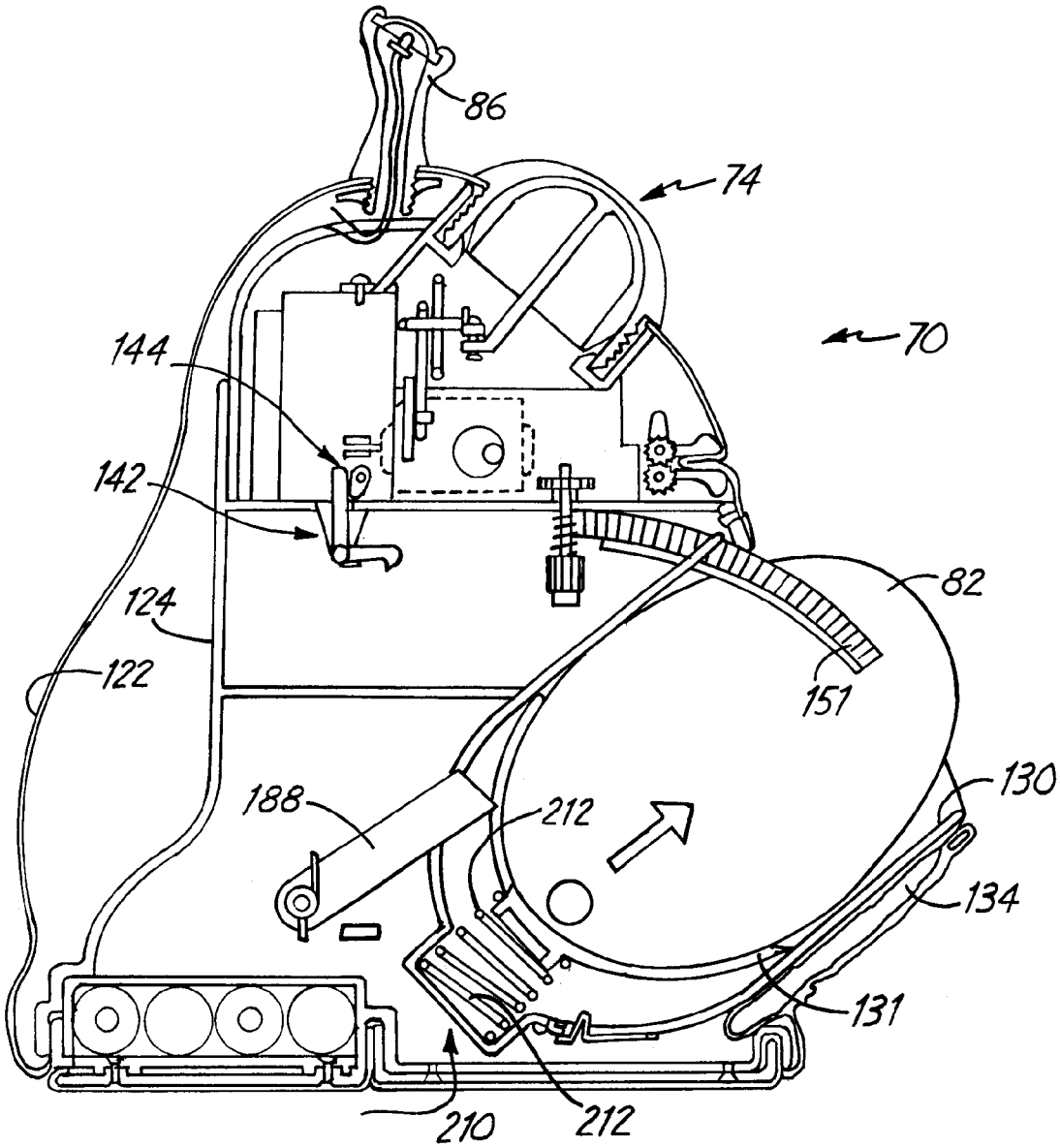
FIG. 8 is an elevational side view depicting another step in the method of the birthing or delivery process of the present invention.
Figure 9:
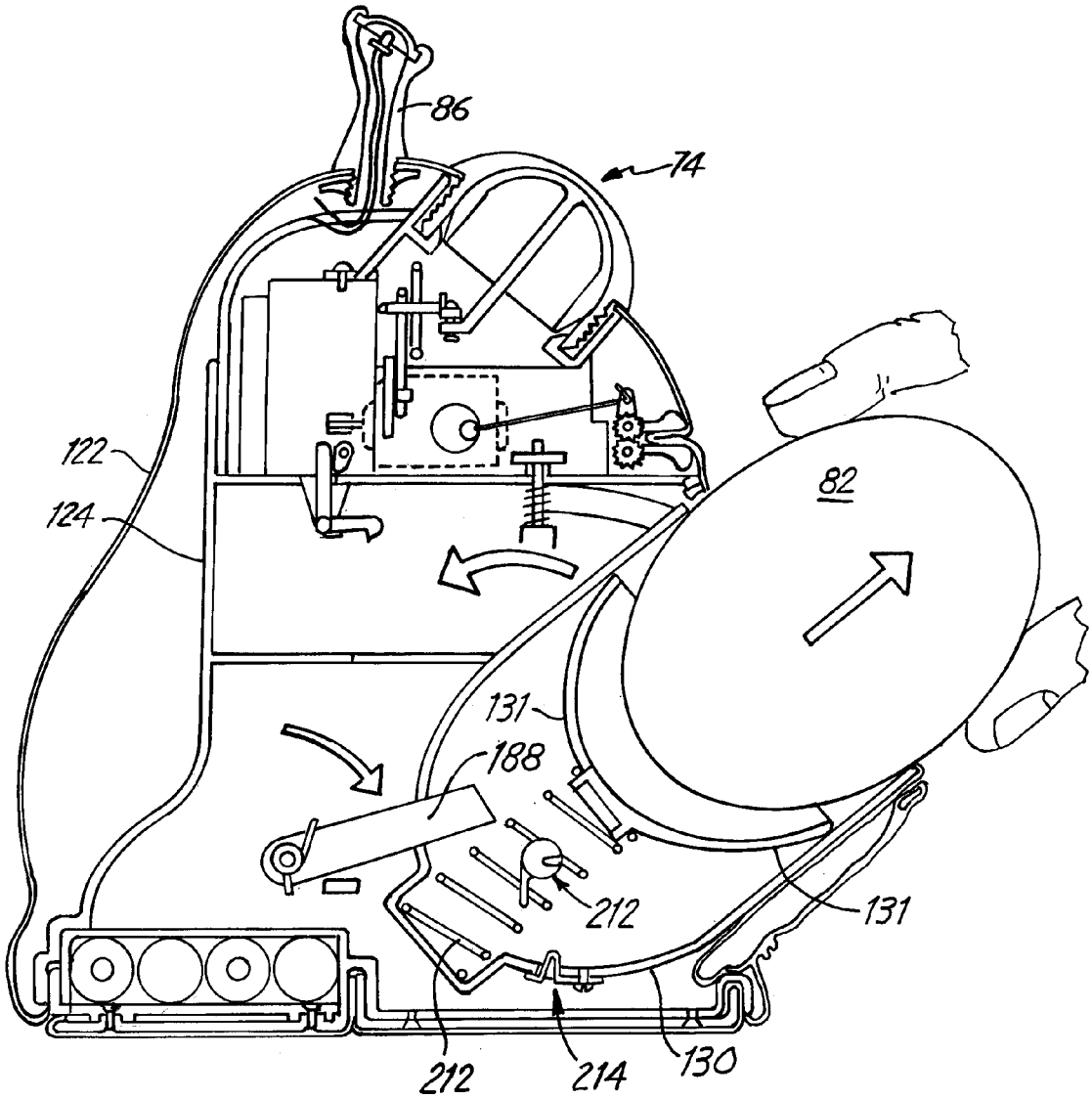
FIG. 9 is an elevational side view depicting another step in the method of the birthing or delivery process of the present invention.

Additional details with respect to the birthing process provided by the amusement device 70 of the present invention are depicted in FIGS. 6–12. Referring to FIG. 6, the lock 142, which includes a spring 202 so the container 130 can be relocked in a closed position is cammed open at the beginning of a delivery to allow the container 130 to open. This lock 142 is provided so that a user cannot simply pry open the container 130. FIG. 7 depicts the opening of the container 130 around its pivot point 204. As the container 130 opens, the catch arm 188 rotates against the container 130 and through the slot 186 provided at the rear of the container 130. If the user tries to force the container 130 closed before the egg 82 is removed, the catch arm 188 rotates into place and doesn't allow the container 130 to shut. It also does not allow the egg 82 to be put back into the container 130 after removal. In at least one embodiment, the catch arm 188 is provided to insure the egg 82 cannot be accidentally closed back inside the mother device 70, i.e., a user must remove the egg 82 to reclose the container 130. Referring to FIGS. 8 and 9, the drive or birthing mechanism 140 for moving the container 130 comprises the pinion gear and rack 148; when the motor 80 is actuated the pinion gear 149 drives the rack 151 to open the container 130. In one embodiment, the mechanism 140 drives the pinion 149 until the container 130 is completely open, and then the gear 149 may permanently disengage. In this embodiment, the device 70 is a single birth device. In some embodiments, at the full extent of travel of the container 130, a pin (not shown) at the base of the container catches a cam, flange or shoulder (not shown) on the floor of the internal frame 124 holding the container 130 open until the egg is removed. In one embodiment, the pinion gear 149 permanently disengages from the rack 151 once the container 130 is open. Note that the egg container 130 may be provided with an ejector 210, including the basket 131 and a spring 212 whereby as soon as the container 130 opens far enough to allow the egg 82 to pass through, the ejector 210 pushes the egg 82 up and out making it more easily removable by a user.

FIG. 9 depicts the delivery or birth of the baby and/or egg 82 wherein the container 130 is fully opened and the user is removing an egg 82 (containing a baby 84, or babies) by hand. Removing the weight of the egg 82 allows a suitable sensing switch (not shown) to operate, and releases the pin so that the container 130 will close. In one embodiment, the container 130 may close permanently. A reed switch 214 makes contact to let the mother device 70 know that the egg 82 has been removed and this is communicated to the microprocessor for control purposes.

Figure 10:
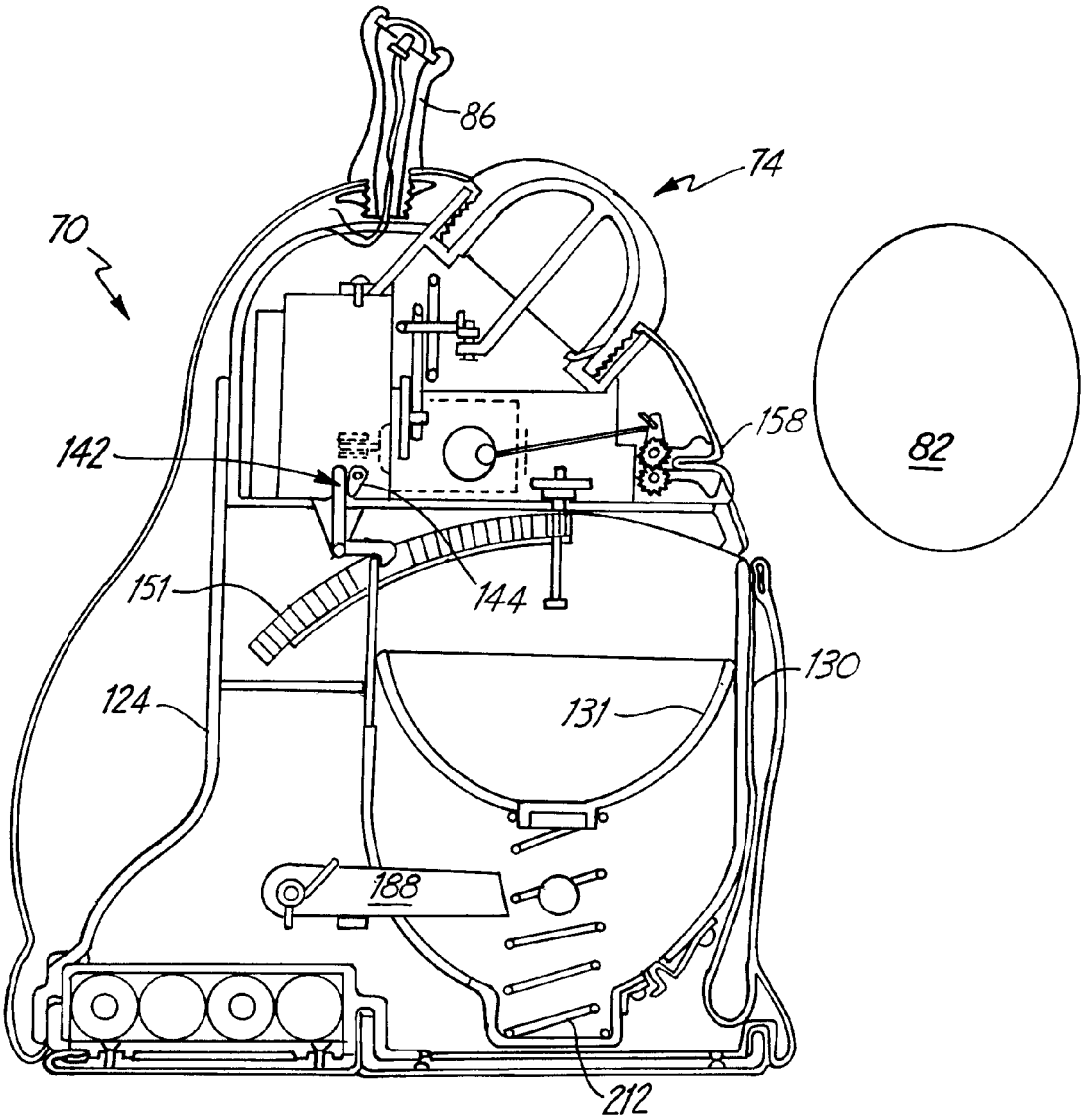
FIG. 10 is an elevational side view depicting another step in the method of the birthing or delivery process of the present invention.

FIG. 10 depicts the container 130 after the birth wherein the ejector 210 is fully extended and the container 130 has been returned to its locked position wherein the lock 142 re-engages the edge of the container 130 so it cannot open. Note that the cam 144 is disengaged from the motor drive so it cannot release the lock 142 again. Also note that the switch 150 stays in contact so that the integrated circuit controller or microprocessor 30 knows that the egg 82 has been removed.

Figure 11A:
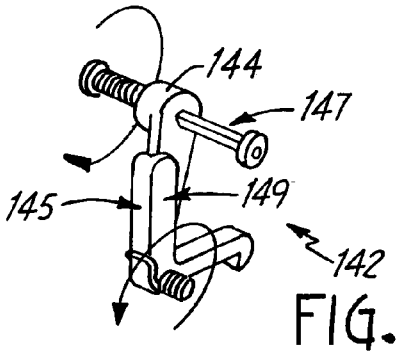
FIGS. 11*a–c*, depicts one embodiment of an operational feature of the birthing or delivery mechanism of the present invention, namely, a lock mechanism.
Figure 11B:
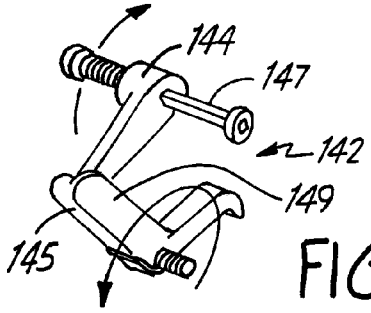
Figure 11C:
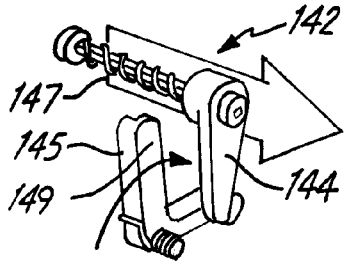
Figure 12A:
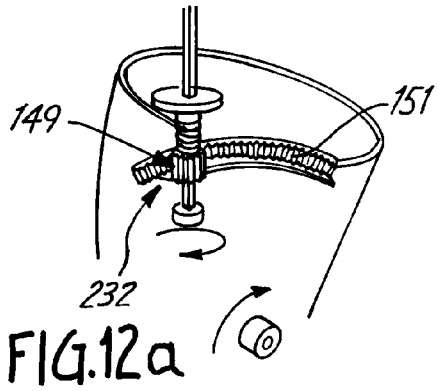
FIGS. 12*a–c*, depicts one embodiment of an operational feature and method of the birthing or delivery mechanism of the present invention, the internal baby container of the mother and a portion of the operating mechanism for moving it.
Figure 12B:
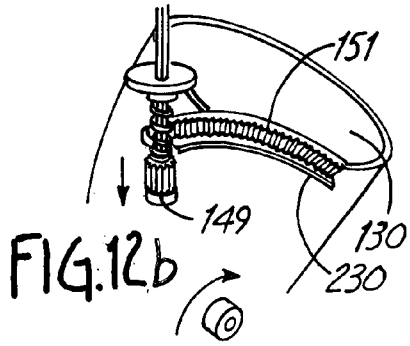
Figure 12C:
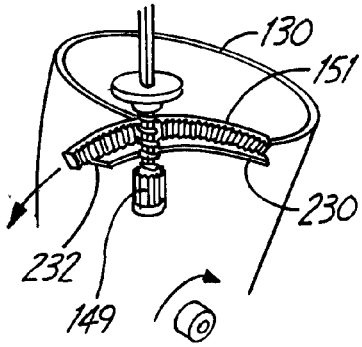

Referring to FIG. 11, additional details of the lock 142 are depicted. When the birth mode begins the lock cam 144 rotates pushing the lock arm 145 up and the lock cam 144 slides freely on the square shaft 147 that is held against the lock arm 145 by the lock arm lip 149. As the lock arm 145. reaches the furthest point in its rotation the lock 142 is opened and the container 130 is free to rotate out. When past the lock arm lip 149, the lock cam 144 is pushed out past the lock arm 145 and never again opens the lock mechanism 142. When the container 130 is returned to its closed position, the lock 142 falls back into place and can't be opened any longer. Similarly, for the one-time birth embodiment, the driving mechanism 148 for opening container 130 may function only once, as depicted in FIG. 12. When the birth mode is actuated the sliding pinion gear 149 rotates against the container rack 151 forcing the container 130 open. The pinion lip 230 keeps sliding pinion 149 in place until the container 130 is fully opened, at which point the drop off gap 232 allows the sliding pinion 149 to slide down past the lip 230, disengaging from the rack 151. After this point, the container 130 cannot be opened mechanically again. In particular, after the egg 82 is removed from the container 130, the container 130 may be rotated by hand back into home position, sliding back past the container opening and then locking shut forever.

Figures 13A, 13B, 13C:
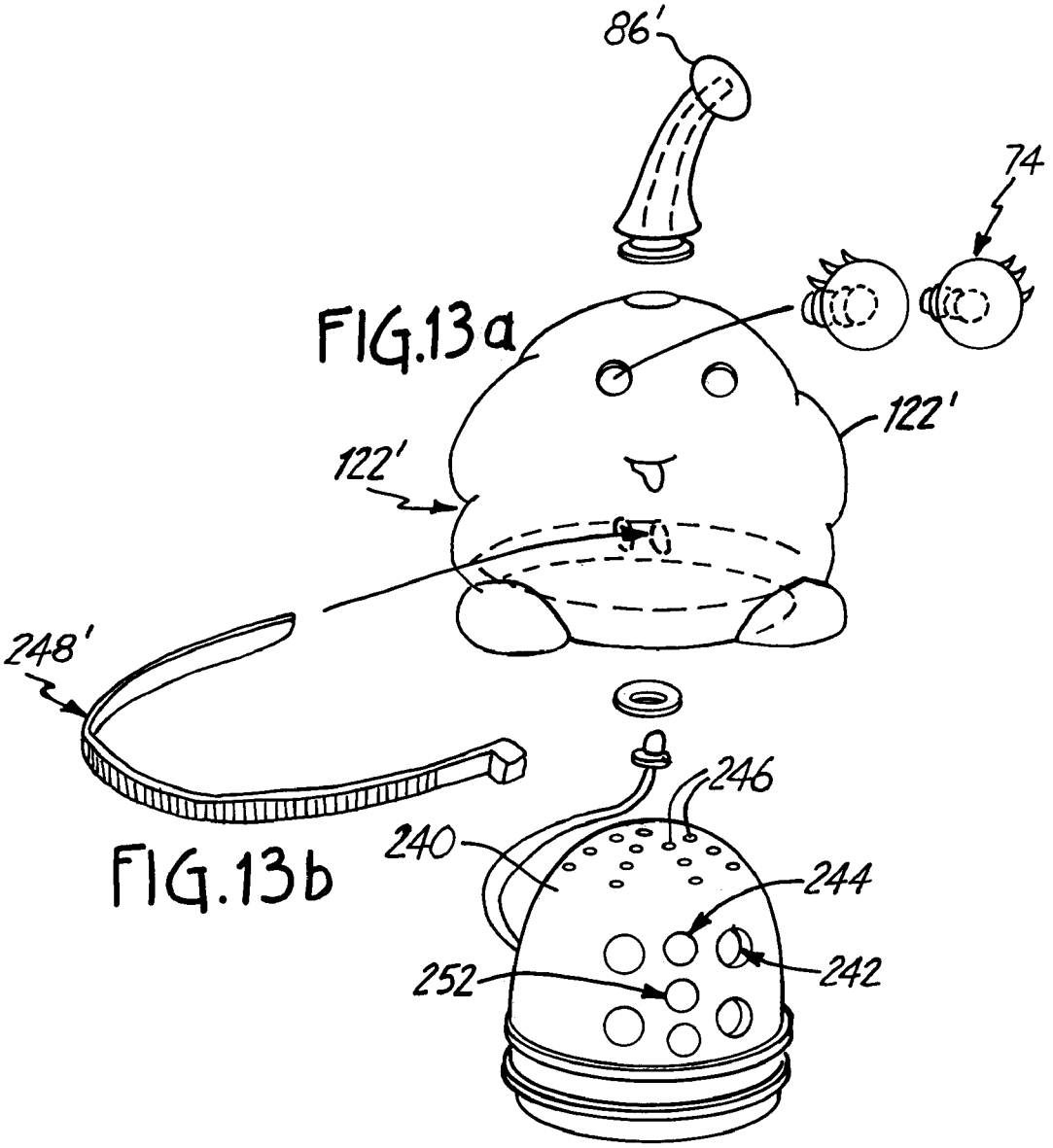
FIGS. 13*a–c*, depicts one embodiment of a baby device.
Figure 14A:
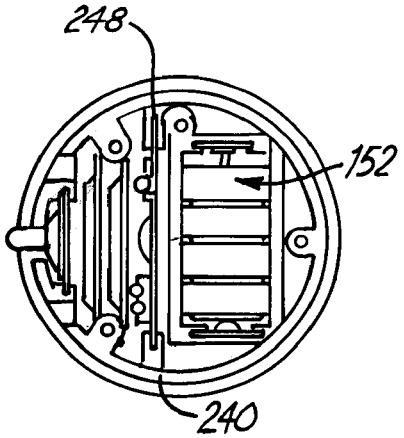
FIGS. 14*a–c*, depicts one embodiment of the baby device of the present invention with portions removed and/or in section to show internal features.
Figure 14B:
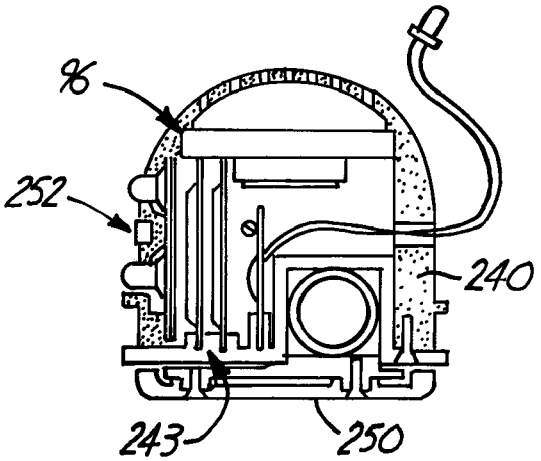
Figure 14C:
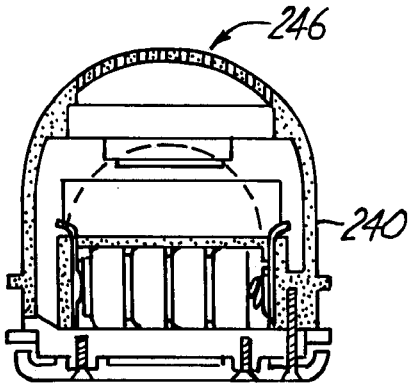

Referring to FIGS. 13 and 14, including FIGS. 14*a–c*, the assembly or structure of one embodiment of the baby device 84 is depicted. The baby device 84 includes an internal frame 240 provided with appropriate through holes, e.g., 242 for receiving and accommodating sensors 243, input and output buttons 244, and speaker vents 246. The frame 240 also mounts a microprocessor 248, and may be provided with a battery hatch 250 and a tie mechanism 248 for tying the skin 122' in place, or the skin 122' may be trapped by the battery hatch 250. As in the mother device, the baby is provided with an antenna 86' which carries a light source 88', such as an LED. The internal frame 240 supports a magnet 252 for the kissing mother device function. FIGS. 14*a–c* depict the mounting of these components on the internal frame 240.

Figure 15A:
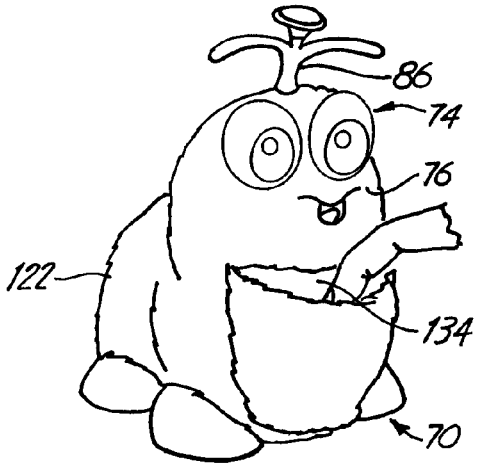
FIGS. 15*a–d*, depicts one embodiment of operational features of the mother device of the amusement device of the present invention.
Figure 15B:
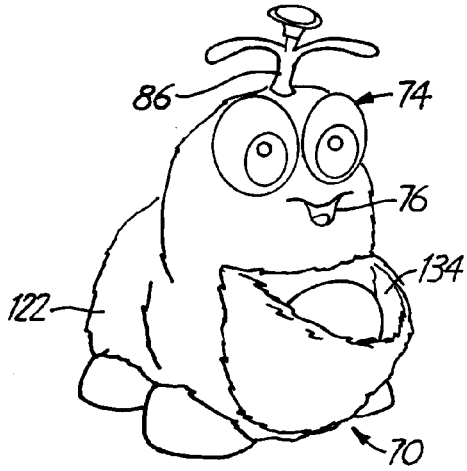
Figure 15C:
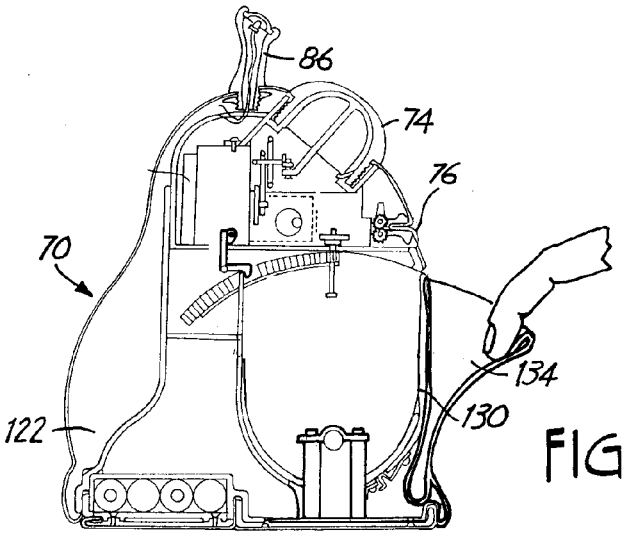
Figure 15D:
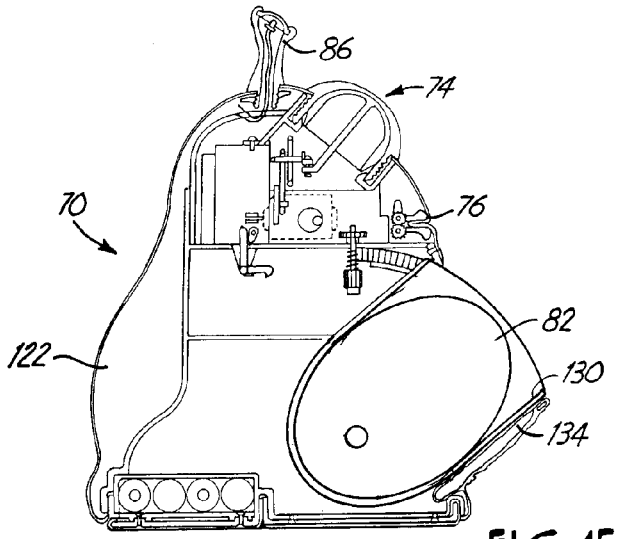

FIG. 15, including FIGS. 15*a–d*, depicts various pouch 134/egg container 130 functions of the amusement device of the present invention, particularly the mother device 70. FIG. 15*a* depicts the exterior of the mother device 70, along with 15*b*, showing that the exterior pouch 134 is always accessible by a user, that it is formed from the same material forming the skin 122 of the mother device 70, such as suitable cloth or fur-like material, and that it is easily opened by a user. FIGS. 15*c* and *d* depict features of the interior container 130 and its interaction with the pouch 134, namely that the container 130 forces open or distends the pouch 134 with the egg 82 being visible, and that it opens mechanically at the time of birth, i.e., when actuated in response to user inputs or in accordance with time passing.

Figures 16A, 16B:
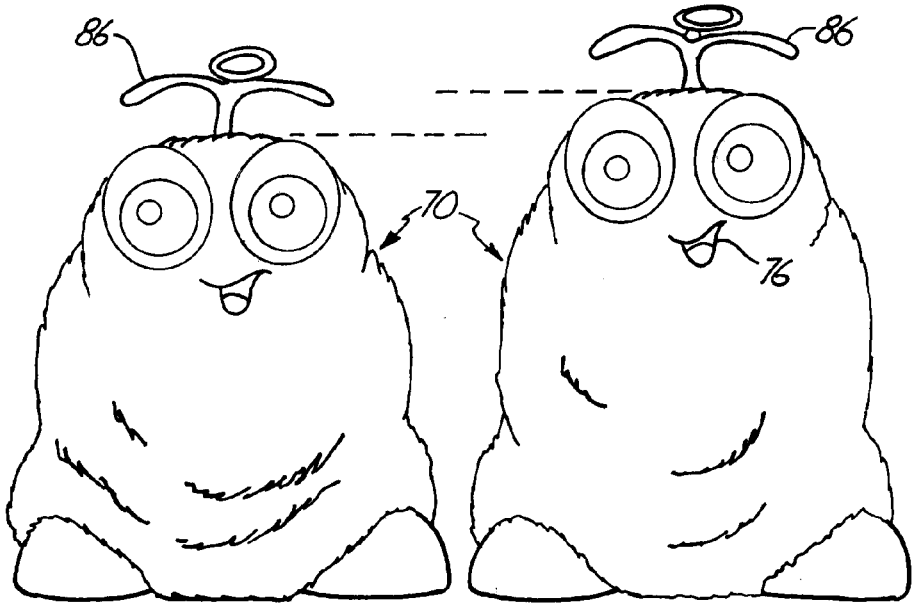
FIG. 16, including FIGS. 16*a* and *b*, depicts one embodiment of the mother device of the present invention and an operational feature thereof, namely, a movement.

FIG. 16 depicts an up and down movement of the head 72 provided by operating the motor 80, which may operate in forward and reverse modes to provide the up and down movement. Alternatively, a suitable rotating or translating linkage (not shown) may be provided to move the head 72 up and down. Total movement may be approximately one inch and may be triggered by the microprocessor controller 30 or by direct input, in some embodiments happening before and after a birth or birth cycle. In one embodiment, when actuated or triggered, the up and down motion may occur a selected number of times per cycle (this may be true of any of the activities of the parent and child figures 70, 84 of the present invention, i.e., their outputs may comprise cycles or periods of activity and inactivity).

Figures 17A, 17B, 17C:
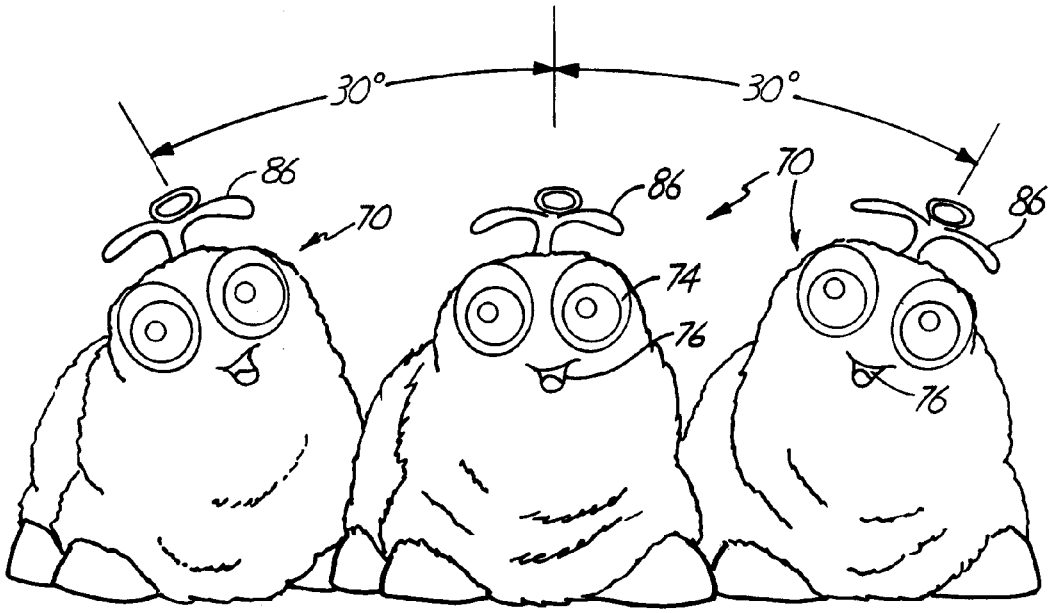
FIGS. 17*a–c*, depicts one embodiment of the mother device of the present invention and another operational feature thereof, namely, another movement.

FIG. 17 depicts a head tilting function of the mother device 70. The motion may range from a full right, a center and a full left position. The right and left positions may be approximately 30° from center. When actuated, the mother device 70 may tilt its head 72 from side to side representing, for example, a happy reaction. This function may happen after the birth or birth cycle, but in some embodiments, never before. The head movement may comprise a full left to right movement with three movements per cycle. This movement, and all motion associated with the devices 70, 84 of the present invention, may be provided by a single motor, e.g., motor 80, operably linked appropriately to movable portions of the devices.

Figure 18A:
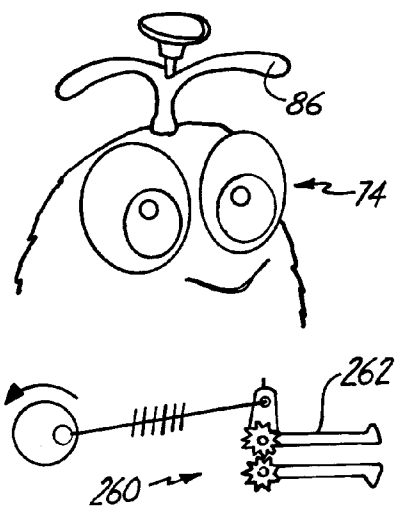
FIGS. 18*a–c*, depicts one embodiment of the mother device of the present invention and a structural and operational feature thereof, namely, the mouth and mouth movement of the device.
Figure 18B:
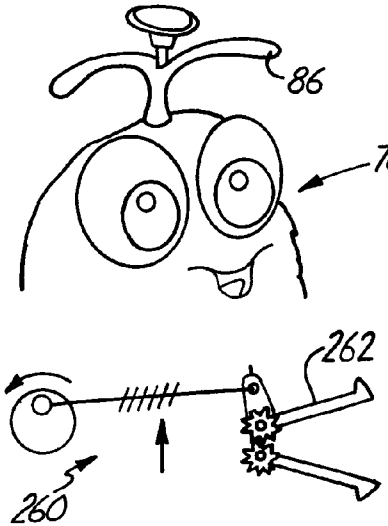
Figure 18C:
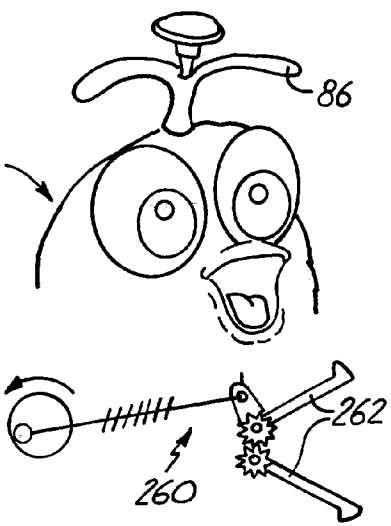
Figure 18D:
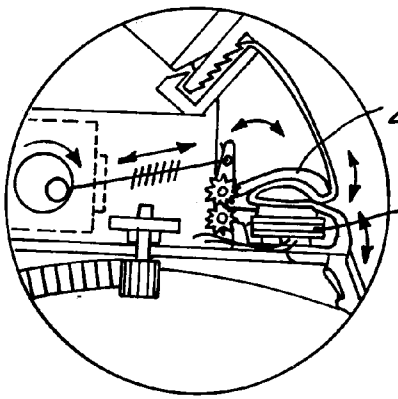
FIG. 18*d* depicts details of one embodiment of the mouth of the mother device.
Figure 19:
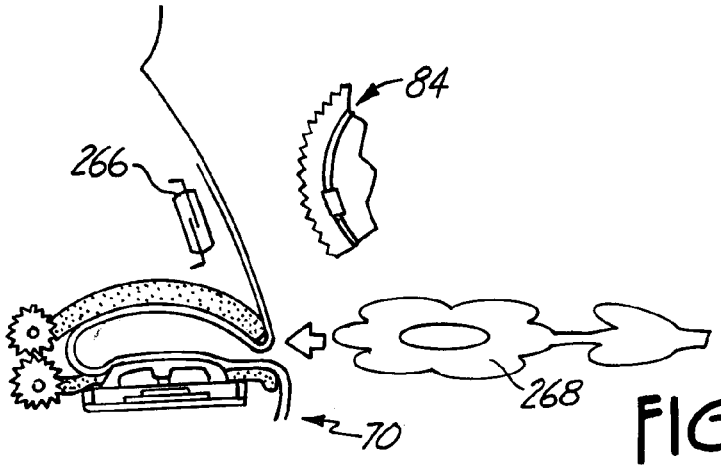
FIG. 19 depicts a portion of the amusement device of the present invention, namely, an embodiment of a mouth structure suitable for either the mother or the baby.

FIG. 18, including FIGS. 18*a–d*, depicts mouth 76 movement and includes a representation of the mouth moving cam and actuation system 260. When activated, the actuation system 260 forces the mouth open and closed to simulate talking. The cycle length of the mouth movement may be controlled by the microprocessor 30, and may depend on or correspond to the length of the sound being produced. FIGS. 18*d* and 19 provide additional detail, showing how the arms 262 are located in the bottom and upper jaw of the mouth 76, and depicting that the devices 70, 84 may be provided with a contact switch 264 for providing a "feeding or eating function" wherein the contact switch 264 is operated by contacting a "food item" pushed into the mouth.

FIG. 19 depicts additional details of a kissing function as well as a eating or feeding function. The kissing function is provided by positioning a magnet 252 carried by the baby 84 adjacent to a reed switch 266 carried by the mother 70 to cause movement of the mother's upper lip. The feeding mechanism, including the contact switch 264 and a "food item" 268, is shown in detail as well.

Figure 20:
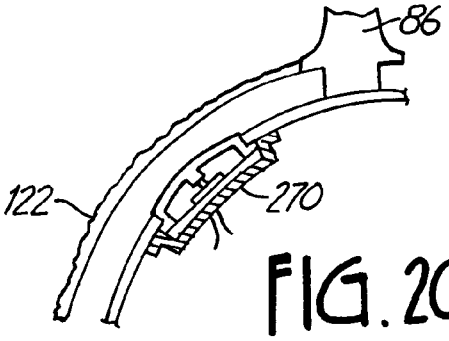
FIG. 20 depicts one embodiment of a feature of the mother device of the present invention, namely, a touch sensor.

FIG. 20 depicts a petting, waking or wake up function wherein the mother 70 is provided with a contact switch 270 adjacent to the antenna 86. For example, if a user pets or contacts the back of the head 72, the switch 270 activates the mother 70, waking her from a sleep mode and causing selected outputs such as sound production or head movement. The switch 270 for receiving the petting motion may be coupled to the microprocessor 30 to sense the petting as a positive input, triggering a positive response.

Figure 21:
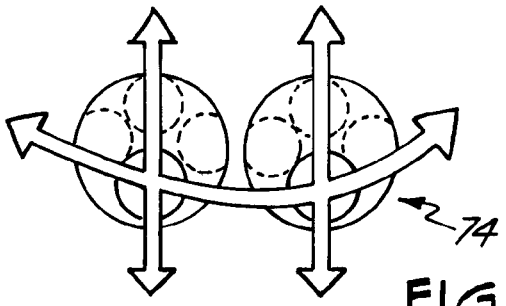
FIG. 21 depicts one embodiment of the operational characteristics a feature of the mother and/or baby of the present invention, namely, movement of the eyes.

FIG. 21 is provided to depict the eye 74 movement provided by the mother device 70 of the present invention. Such movement may be triggered at the occurrence of certain events, for example, a birth or perceived input from the user. The eyes 74 may move in a left to right curved swooping motion and/or may move in a random rotational motion. Whichever motion of the eyes 74 occurs, it should be smooth. A selected motion may occur upon the occurrence of a particular event, for example, after a birth sequence, the eyes 74 may move in a swooping motion left and right. And before a birth sequence, the eyes 74 may be triggered to move up and down. Additionally, eye movement may be triggered by perceived input such as sound or petting, and the eyes 74 may then move in a random rotation, for example, to any of the positions shown in phantom. Typically, the eyes 74 move in a cycle comprising three to six repetitions of the movement, no set rest position is provided, the drive mechanism (see FIG. 22) may leave the eyes in any position at the time of stop.

Figure 22:
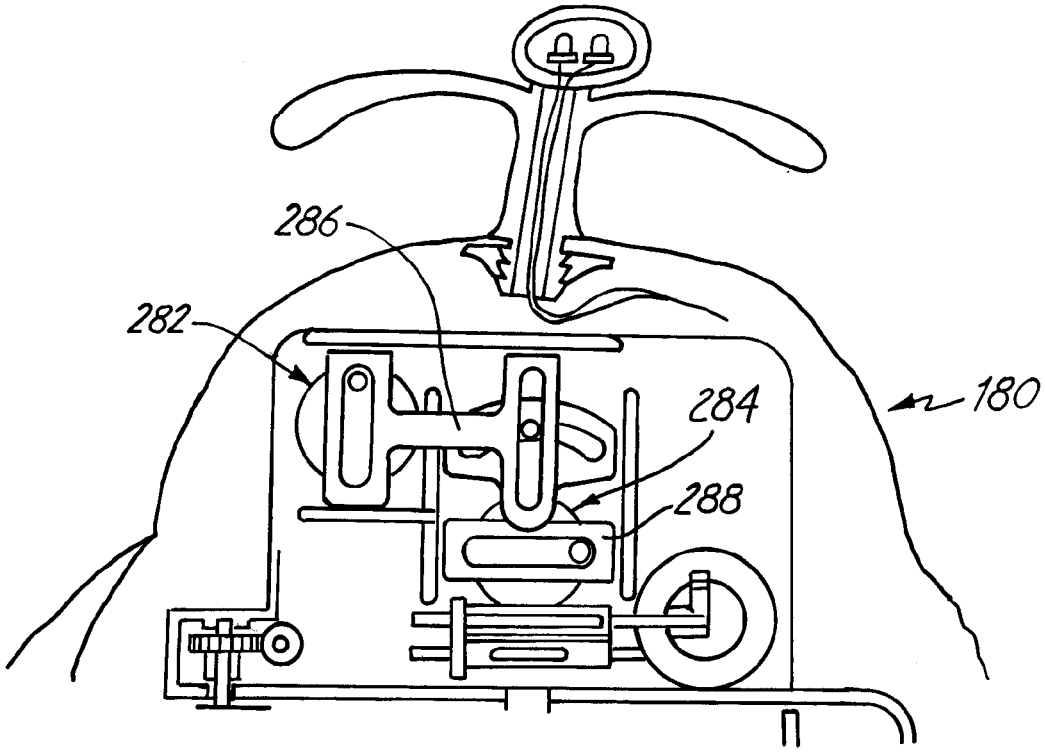
FIG. 22 depicts one embodiment of the eye moving mechanism of the present invention.

FIG. 22 shows the eye drive mechanism 180, particularly the eye cams 282, 284 and followers 286, 288 and how they are combined to create the unique eye movement. Note that with reference to the gearing of the drive linkage depicted in FIG. 5, the cams may operate a different selected speeds so that the eye movement always changes. With reference then to FIG. 22, the left/right cam 282 moves the eyes 74 left and right and moves more slowly than the up/down cam 284. For example, a 25 tooth gear may be used instead of a 22 tooth gear. Also, with respect to the left/right cam 282, it operates in both motor directions. The up/down cam 284 moves the eyes 74 up and down, moves faster and operates only when the motor moves into reverse, e.g., into the non-egg laying or birthing direction.

Figure 23:
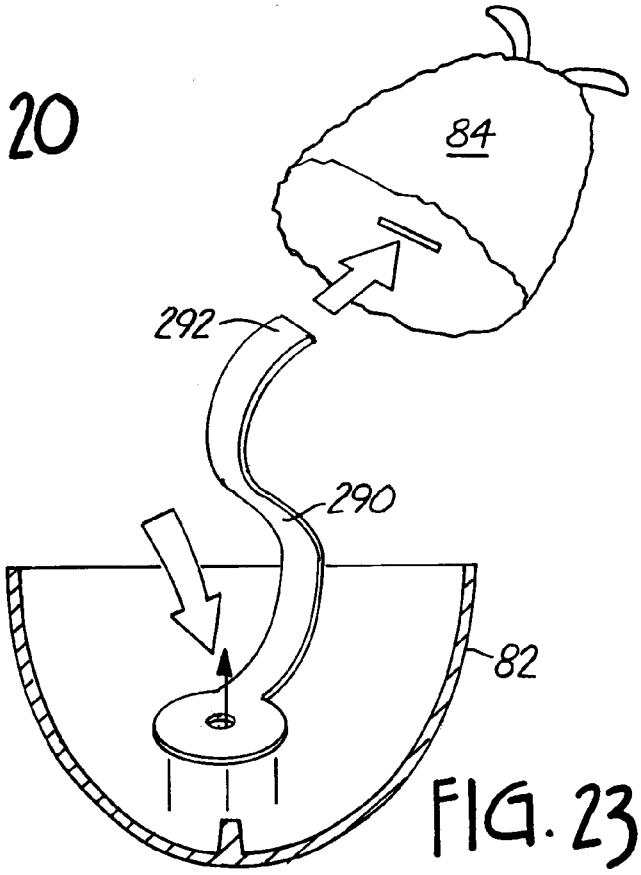
FIG. 23 depicts one embodiment of an operational of the baby of the present invention, namely, an actuating mechanism.

FIG. 23 is provided to depict a pull-tab 290 and its function whereby the baby 84 is automatically actuated when removed from the egg 82. A tab 290 is heat staked suitably inside an egg 82 and, after a user opens the egg 82 and takes the baby 84 out, the free end 292 of the tab 290 pulls out of the baby 84 sensing the separation from the egg 82 and automatically actuating the baby device 84 for interaction with both the mother device 70 and a user.

In exemplary use, after power is supplied to the mother 70, she may sleep, or appear to be inactive for a selected period of time, then automatically, under control of the microprocessor 30, appear to wake up, i.e., emit selected outputs such as sound or movement. Birth of the baby 84 may appear to be spontaneous, occurring after a period of time, or it may occur as a result of intentional or inadvertent input from a user or the environment. For example, the mother 70 may require petting or touching by a user to actuate the birthing process, or may require "feeding" to give birth. Similarly, interaction between the mother 70 and baby 84, i.e., communication among the various outputs and inputs of each, may appear to be spontaneous, e.g., when placed near each other, the mother 70 may talk to the baby 84, the mother 70 may ask that the baby 84 be placed near her, the baby 84 may ask to be fed, etc. These various functions may be appropriately controlled by the software and program flows associated with the microprocessor 30, 248 (or microprocessors) carried by the mother 70 and/or baby 84. Such software and program may be designed to include appropriate function and decision points as known to those skilled in art.

The present invention may be embodied in other specific forms without departing from the essential spirit or attributes thereof. For example, outputs other than those described herein may be provided, and the figures may take the form of "plush" toys, human or animal figures, or whimsical figures. It is desired that the described embodiments be considered in all respects as illustrative, not restrictive.

What is claimed is:

1. An amusement device comprising:

(a) a first figure comprising:

(i) a body defining a body cavity; and (ii) a container receivable in the body cavity, the container having a container cavity and a container opening defined by a container wall, wherein the container is configured to be movable between a closed position within the body cavity and an open position wherein the container cavity is accessible; and (b) a second figure receivable in and removable from the container cavity when the container is in the open position.

2. The amusement device of claim 1 further comprising an operating mechanism operably coupled to the container, the operating mechanism configured to move the container between the closed and open positions.

3. The amusement device of claim 1 wherein the first figure is interactive.

4. The amusement device of claim 3 wherein the second figure is interactive.

5. The amusement device of claim 1 wherein the first and second figures are digitally interactive with each other and with a user.

6. The amusement device of claim 5, wherein the first and second figures are digitally interactive with ambient conditions.

7. An amusement device comprising:

(a) a parent figure comprising:

(i) an internal structure defining an internal cavity accessible through an opening in the internal structure;

(ii) a skin covering at least a portion of the internal structure;

(iii) a housing receivable in the internal cavity, the housing defining a housing cavity and being configured to be movable between a closed position wherein a housing wall is configured to block the opening and an open position wherein the housing cavity is accessible through the opening; and (iv) an operating mechanism operably coupled to the housing, the operating mechanism configured to move the housing between the closed and open positions; and (b) a child figure receivable in and removable from the container cavity when the container is in the open position.

8. The amusement device of claim 7 further comprising a microprocessor operably coupled to the operating mechanism, the microprocessor configured to actuate the operating mechanism.

9. The amusement device of claim 8 further comprising one or more inputs operably coupled to the microprocessor, the one or more inputs configured to provide information to the microprocessor.

10. The amusement device of claim 7 wherein the movement of the housing between the closed and open positions is independent of intentional user input.

11. The amusement device of claim 7 wherein the operating mechanism comprises an electric motor.

12. The amusement device of claim 11 wherein the body of the parent figure further comprises movable portions.

13. The amusement device of claim 12 wherein the movable portions move in response to one of a sensed condition and a user input.

14. The amusement device of claim 13 wherein the parent figure is adapted to provide a visual output.

15. The amusement device of claim 7 wherein the parent and child figures are interactive with each other and with a user.

16. The amusement device of claim 7 wherein the parent and child figures further comprise sensors whereby they interact with each other.

17. The amusement device of claim 7 wherein the parent figure is adapted to emit sound.

18. The amusement device of claim 7 wherein the skin includes a pouch generally overlying the opening.

19. The amusement device of claim 7 wherein the housing is permanently locked in the closed position when moved to the closed position from the open position.

20. The amusement device of claim 7 wherein the housing is releaseably lockable in the open position and releaseably lockable in the closed position.

21. The amusement device of claim 7 wherein the housing is pivotably movable between the closed position and the open position.

* * * * *